US008272733B2

(12) United States Patent
Ikeda et al.

(10) Patent No.: US 8,272,733 B2
(45) Date of Patent: Sep. 25, 2012

(54) PRINTER APPARATUS

(75) Inventors: Akira Ikeda, Tomi (JP); Masaru Ohnishi, Tomi (JP)

(73) Assignee: Mimaki Engineering Co., Ltd., Tomi-Shi (JP)

( * ) Notice: Subject to any disclaimer, the term of this patent is extended or adjusted under 35 U.S.C. 154(b) by 0 days.

(21) Appl. No.: 12/955,932

(22) Filed: Nov. 30, 2010

(65) Prior Publication Data

US 2011/0109711 A1 May 12, 2011

Related U.S. Application Data

(63) Continuation of application No. PCT/JP2008/072856, filed on Dec. 16, 2008.

(51) Int. Cl.
*B41J 2/01* (2006.01)

(52) U.S. Cl. ..... 347/104; 347/37

(58) Field of Classification Search ..... 347/37, 347/104

See application file for complete search history.

(56) References Cited

U.S. PATENT DOCUMENTS

| | | | |
|---|---|---|---|
| 6,164,755 | A | 12/2000 | Yamamoto |
| 2008/0278560 | A1* | 11/2008 | Niekawa ..... 347/102 |

FOREIGN PATENT DOCUMENTS

| | | |
|---|---|---|
| JP | 09-11508 | 1/1997 |
| JP | 09-240097 | 9/1997 |
| JP | 2006-341420 | 12/2006 |
| JP | 2007-030253 | 2/2007 |

OTHER PUBLICATIONS

International Search Report for International Application No. PCT/JP2008/072856, Jan. 27, 2009.

* cited by examiner

*Primary Examiner* — Julian Huffman
*Assistant Examiner* — Sharon A Polk
(74) *Attorney, Agent, or Firm* — Ditthavong Mori & Steiner, P.C.

(57) ABSTRACT

A printer apparatus includes a guide rail, a first device including a first head, a second device including a second head, and a hauling device including a driving member movable between the first device and the second device. A first holding mechanism is provided on one side with respect to a medium supporter. A second holding mechanism is provided on another side with respect to the medium supporter. When ink is to be ejected from the first head, the second holding mechanism holds the second device separated from the driving member, and a first connecting mechanism connects the first device to the driving member. When ink is to be ejected from the second head, the first holding mechanism holds the first device separated from the driving member, and a second connecting mechanism connects the second device to the driving member.

17 Claims, 12 Drawing Sheets

BACKGROUND ART

PRINTER APPARATUS

CROSS-REFERENCE TO RELATED APPLICATIONS

The present application is a continuation application of International Application No. PCT/JP2008/072856, filed Dec. 16, 2008. The contents of this application are incorporated herein by reference in their entirety.

BACKGROUND OF THE INVENTION

1. Field of the Invention

The present invention relates to a printer apparatus.

2. Discussion of the Background

The printer apparatus (inkjet printer) is structured so that, while a carriage on which printer heads are mounted is relatively moved, for example, in a lateral direction with respect to a printing medium reciprocatedly, ink is ejected from an ejection nozzle formed on an under face of the printer head to perform predetermined printing on a surface of the printing medium. Respective printer heads for respective colors, for example, of magenta (M), yellow (Y), cyan (C) and black (K) (hereinafter, these four colors are referred to as "basic color") are mounted on the carriage, inks ejected from these printer heads are adhered to the surface of the printing medium with predetermined densities to express various colors. Further, in the above-mentioned printer apparatus, a mechanism referred to as a maintenance device is commonly provided in which ink within the ejection nozzle is sucked in a state that an under face of the printer head is covered to recover to a state that ink is capable of being ejected normally.

Recently, there has been a demand that printing with further fine colors is performed and, in order to attain this demand, a printer apparatus has been proposed in which, for example, in addition to the basic colors, printer heads for orange, blue and the like (hereinafter, referred to as "special color" to the basic colors) are mounted on the carriage. For example, in FIG. 2 of Japanese Patent Laid-Open No. H09-11508, a printer apparatus is disclosed in which inkjet heads 9C, 9M, 9BK, 9OR and 9BL corresponding to the basic colors, orange and blue are mounted on a carriage 9 which is movably supported.

An example of a conventional printer apparatus is shown in FIG. 12 in which special colors are mounted in addition to the basic colors as described above. FIG. 12 is a perspective view showing a vicinity of a printing device 600 of a printer apparatus 500. The printing device 600 is structured so that printer heads 620M, 620Y, 620C, 620K, 620OR and 620BL corresponding to the basic colors, orange and blue which are arranged side by side in the lateral direction are mounted on a carriage 610 which is attached so as to be movable in the lateral direction with respect to guide rails 510 on an upper side of a flat plate-shaped platen 520. A maintenance device 700 is provided on a left side of the platen 520 and six suction caps 710 are disposed on an upper face of the maintenance device 700 side by side in the lateral direction so as to correspond to the number of the printer heads which are mounted on the carriage 610. Each of the printer heads is connected with an ink cartridge (not shown) provided in the printer apparatus 500 through a supply tube (not shown).

At normal printing, the basic colors are frequently used (ejected) and relatively large quantities of their inks are consumed. However, the use frequencies of the special colors such as orange, blue and the like are often extremely low (hardly used) in comparison with the use frequencies of the basic colors. Therefore, like the printer apparatus 500 shown in FIG. 12, when the printer heads for the special colors which are hardly used at normal printing are previously mounted on the carriage 610 and connected with supply tubes and the suction caps 710 corresponding to the printer heads for the special colors are previously provided in the maintenance device 700, more cost than required is used and, in addition, there is much waste in an arrangement space in the lateral direction. As a result, its manufacturing cost is increased and the size of the printer apparatus 500 is made larger.

SUMMARY OF THE INVENTION

According to one aspect of the present invention, a printer apparatus includes a guide rail, a first device, a second device, a hauling device, a first connecting mechanism, a second connecting mechanism, a first holding mechanism, and a second holding mechanism. The guide rail faces a medium supporter to support an object medium. The guide rail is relatively movable in a predetermined feeding direction with respect to the object medium supported by the medium supporter. The guide rail extends in a scanning direction perpendicular to the predetermined feeding direction. The first device includes a first carriage and a first head. The first carriage is movable in the scanning direction along the guide rail. The first head is mounted on the first carriage so that ink is ejected to the object medium from the first head. The second device includes a second carriage and a second head. The second carriage is movable in the scanning direction along the guide rail. The second head is mounted on the second carriage so that ink is ejected to the object medium from the second head. The hauling device includes a driving member. The driving member is movable in the scanning direction between the first device and the second device. The first connecting mechanism connects the first device to the driving member when ink is to be ejected from the first head. The second connecting mechanism connects the second device to the driving member when ink is to be ejected from the second head. The first holding mechanism is provided on one side with respect to the medium supporter in the scanning direction. The first holding mechanism holds the first device separated from the driving member when ink is ejected from the second head. The second holding mechanism is provided on another side with respect to the medium supporter in the scanning direction. The second holding mechanism holds the second device separated from the driving member when ink is ejected from the first head.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6A shows a state before connection, FIG. 6B shows a state after having been connected, and FIG. 6C shows a state where the connection has been released;

DESCRIPTION OF THE EMBODIMENTS

Figure 1:
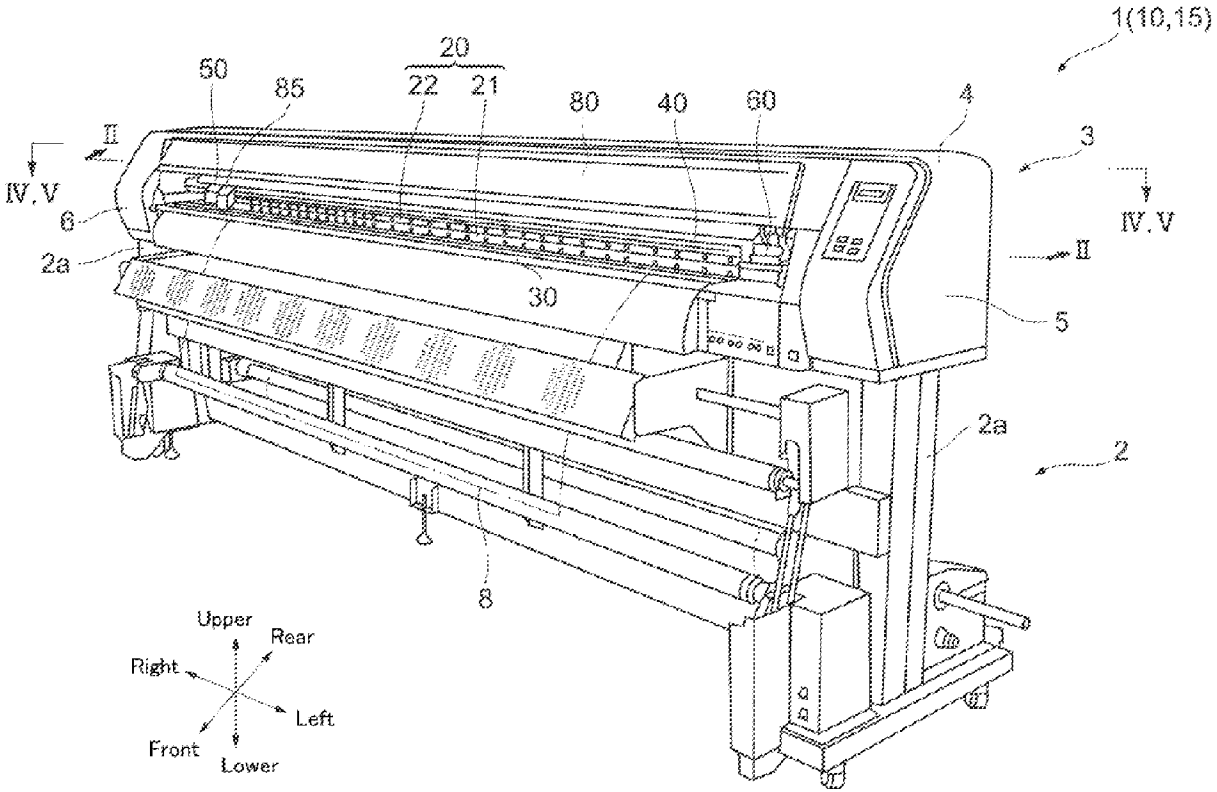
FIG. 1 is a perspective view showing an outward appearance of a printer apparatus in accordance with embodiments of the present invention (first through third embodiments)

First through third embodiments of the present invention will be described below as a preferred embodiment with reference to the accompanying drawings, wherein like reference numerals designate corresponding or identical elements throughout the various drawings. In the following description, in convenience of description, arrow directions shown in respective drawings are respectively defined as a front and rear direction, a right and left direction and an upper and lower direction.

[First Embodiment]

Figure 3:
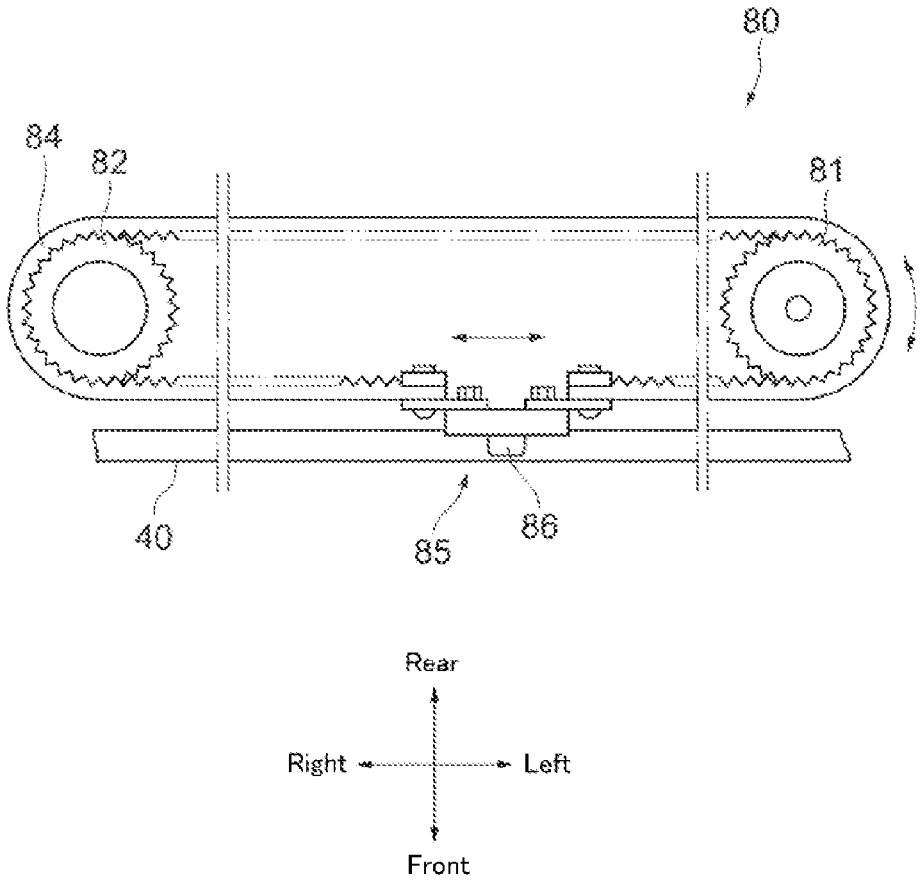
FIG. 3 is a plan view showing a drive device of the printer apparatus.
Figure 4:
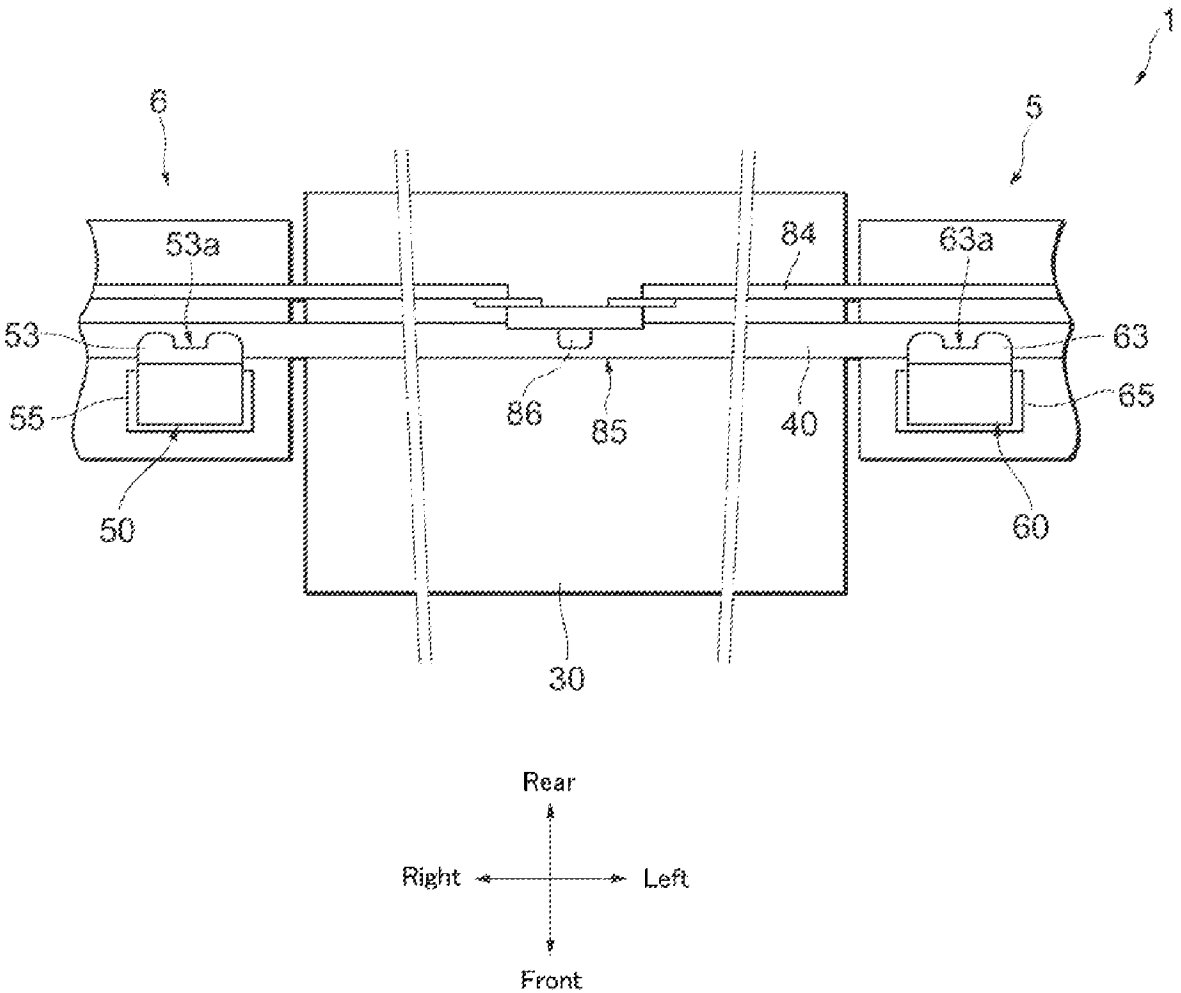
FIG. 4 is a plan view showing a vicinity of a guide rail of the printer apparatus.
Figure 5:
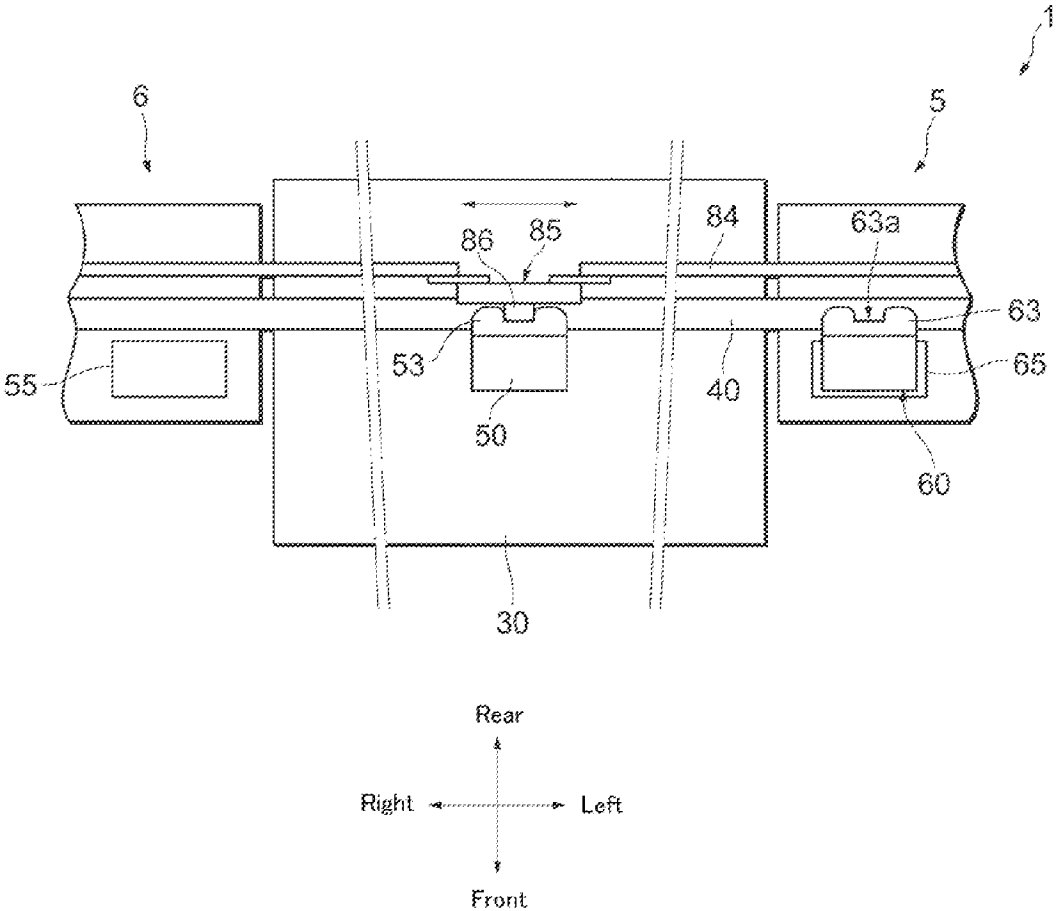
FIG. 5 is a plan view showing a vicinity of a guide rail of the printer apparatus.
Figure 6A:
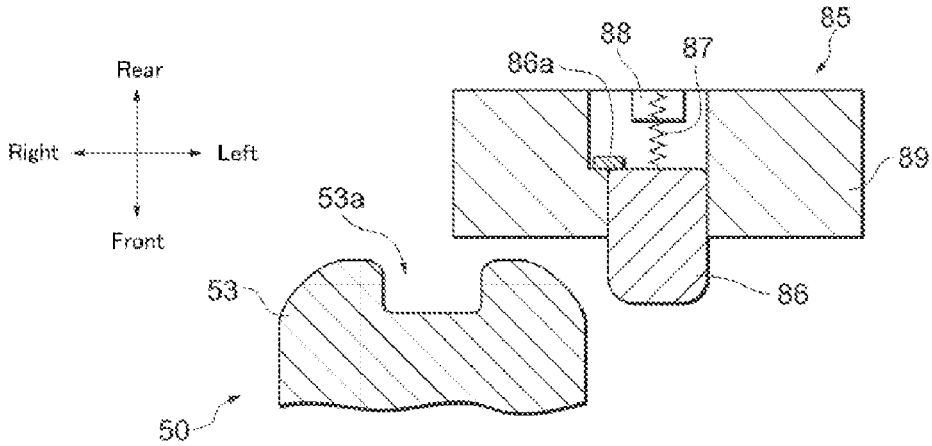
FIGS. 6A, 6B and 6C are cross-sectional views showing a connecting portion of a drive carriage with a connecting part.
Figure 6B:
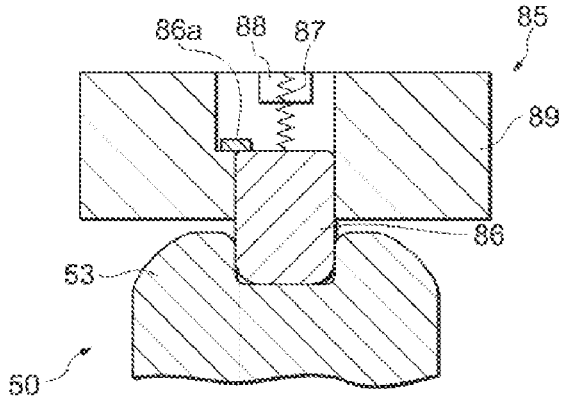
Figure 6C:
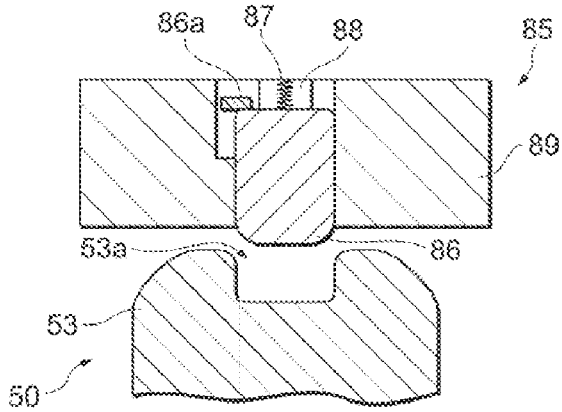

A structure of a printer apparatus 1 in accordance with a first embodiment will be described below with reference to FIGS. 1 through 6C. FIG. 1 is a perspective view showing the printer apparatus 1, FIG. 2 shows an internal structure of a main body part 3 described below, FIG. 3 is a plan view showing an drive device 80 described below, FIGS. 4 and 5 are plan views showing the main body part 3, and FIGS. 6A, 6B and 6C are cross-sectional views showing a connecting portion of a drive carriage 85 with a connecting part 53 described below.

The printer apparatus 1 is, as shown in FIG. 1, structured of a main body part 3 which is extended in a right and left direction and a support part 2 which is provided with a pair of legs 2*a* and 2*a* on right and left sides for supporting the main body part 3. A left main body part 5 and a right main body part 6 are respectively formed at right and left end parts of the main body part 3 and their outer peripheral portions are covered with a main body cover 4. An inside of the left main body part 5 is provided with a controller (not shown) which outputs an operation signal to respective structure portions of the printer apparatus 1 described below to control their operations. A feed mechanism 20, a platen 30 which supports a printing sheet 8 which is an object to be printed, a guide rail 40 which is extended in the right and left direction on an upper side of the platen 30, a first printing device 50 and a second printing device 60 which are movable along the guide rail 40 in the right and left direction, a drive device 80 and the like are disposed and structured between the left main body part 5 and the right main body part 6. A face of the platen 30 which face a printer head 52 (printer head 62) described below in the upper and lower direction is formed so as to extend in the front and rear direction and in the right and left direction.

The feed mechanism 20 is structured mainly of a plurality of pinch rollers 22 which are rotatably disposed side by side in the right and left direction and a feed roller 21 which is provided on an under side of the pinch rollers 22 and on a rear side of the platen 30. When the feed roller 21 is rotated in a state that a printing sheet 8 is sandwiched between the feed roller 21 and the pinch rollers 22, the printing sheet 8 is fed by a predetermined distance in the front and rear direction.

Figure 2:
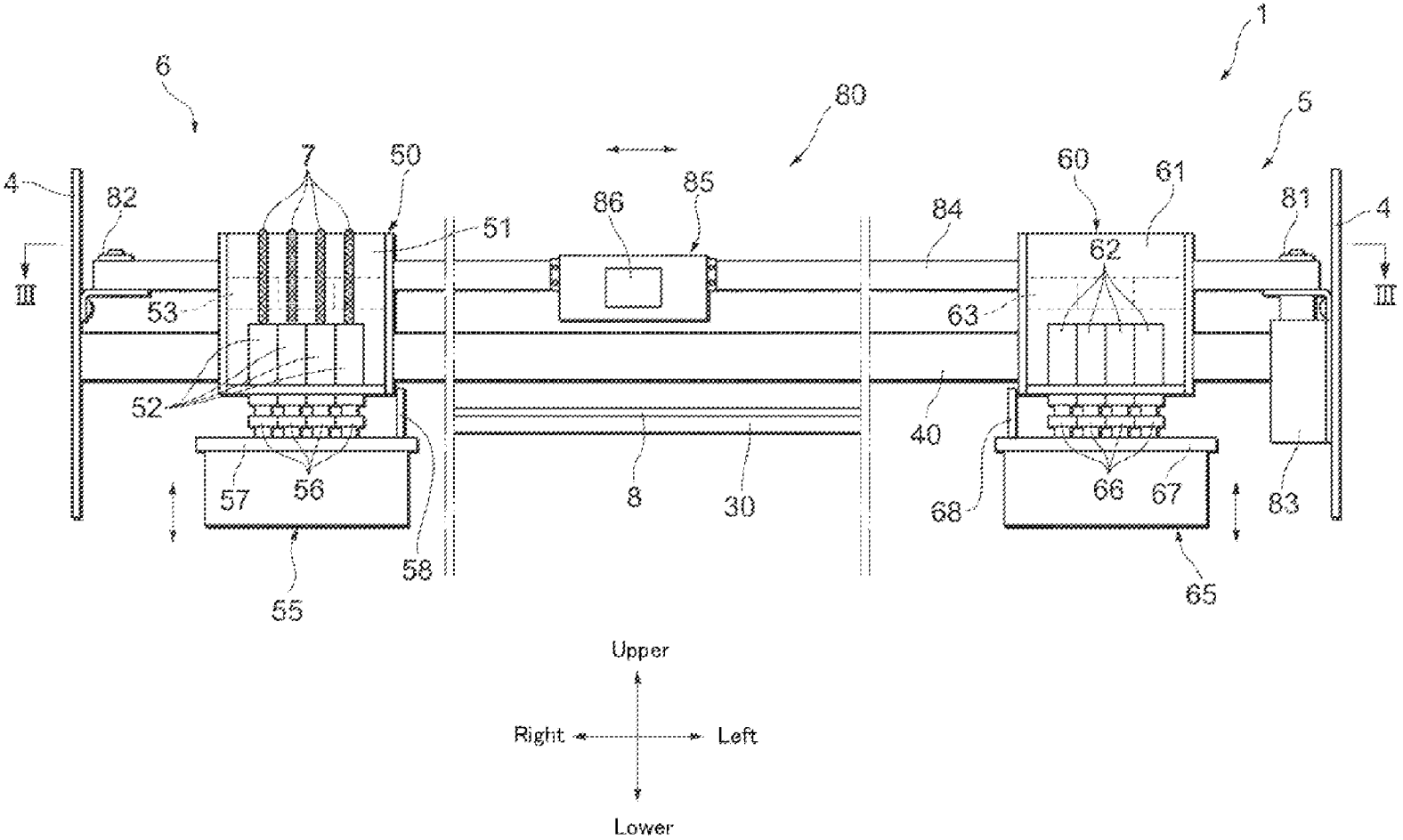
FIG. 2 is a front view showing a vicinity of a guide rail of a printer apparatus in accordance with the first embodiment.

The first printing device 50 is, as shown in FIG. 2, mainly structured of a carriage 51 which is attached to the guide rail 40 so as to be movable in the right and left direction and a plurality of printer heads 52 which are structured of basic colors such as magenta, yellow, cyan and black. A plate-shaped connecting part 53 whose center portion is formed with a fitting recessed part 53*a* is provided on the rear side of the carriage 51 so as to extend to a rear side (see FIG. 4) and a fitting projection 86 of a drive carriage 85 described below is arranged so as to be capable of fitting to the recessed part 53*a*. The printer heads 52 are mounted on the carriage 51 in a state that a plurality of ejection nozzles (not shown) from which ink is ejected is directed to a lower side. The printer head 52 is connected with an ink cartridge (not shown) which is mounted on the printer apparatus 1 through a tube 7 and ink of the ink cartridge is supplied through the tube 7. In accordance with an embodiment, when printing is performed in which light magenta (Lm) and light cyan (Lc) are used at a similar frequency to the above-mentioned four colors, six colors in which light magenta and light cyan are previously added to the four colors may be used as the basic colors.

The second printing device 60 is mainly structured of a carriage 61 which is attached to the guide rail 40 so as to be movable in the right and left direction and a plurality of printer heads 62 which are structured for four special colors (for example, white, metallic, pearl and fluorescent color which are unable to be printed with the basic colors simultaneously). Similarly to the carriage 51, a plate-shaped connecting part 63 whose center portion is formed with a fitting recessed part 63*a* is provided so as to extend to a rear side (see FIG. 4). The printer heads 62 are, similarly to the printer heads 52, mounted on the carriage 61 in a state that a plurality of ejection nozzles (not shown) from which ink is ejected is directed to the lower side. However, different from the printer head 52, the printer heads 62 are respectively structured so that a predetermined quantity of ink is capable of being stored in the inside of the head and mounted on the carriage 61 in a detachable manner. The special colors mounted on the carriage 61 are not limited to the above-mentioned four colors. For example, printer heads 62 for clear ink, orange, green, vermilion red and bluish white may be mounted. Further, when printing is to be performed on a printing medium on which ink is hard to adhere, a printer head 62 in which coupling agent for enhancing an adhesive force is stored may be mounted on the carriage 61. In addition, when coating is to be performed on a printing surface, a printer head 62 in which overcoat agent is stored may be mounted on the carriage 61.

The drive device 80 is, as shown in FIGS. 2 and 3, mainly structured of a drive pulley 81 and a driven pulley 82, which are provided at upper positions in the right and left end parts of the guide rail 40, a right and left drive motor 83 for rotatably driving the drive pulley 81, a band-shaped drive belt 84 which is stretched over the pulleys 81 and 82, and a drive carriage 85 which is connected with the drive belt 84. Further, as shown in FIG. 3, the drive belt 84 is a toothed belt and the pulleys 81 and 82 are formed in a toothed shape to prevent belt slip. In accordance with an embodiment, for example, a stepping motor, a servomotor or the like may be used as the right and left drive motor 83.

The drive belt 84 is not formed in a loop-like shape in itself and the drive carriage 85 is connected with both end parts of the drive belt 84. The drive carriage 85 is structured to move in the right and left direction above the guide rail 40. The drive carriage 85 is, as shown in FIGS. 6A, 6B, and 6C, mainly structured of a main body part 89, a fitting projection 86 which is made, for example, of metal material and inserted into the main body part 89 so as to be movable in the front and rear direction, an urging spring 87 which urges the fitting projection 86 to a front side with respect to the main body part 89, and an electromagnet 88 which is attached to the main body part 89 so as to be located on a rear side of the fitting projection 86. A front and rear stopper 86*a* is attached to a rear end face of the fitting projection 86.

The electromagnet 88 is capable of controlling generation of a magnetic force based on an operation signal from the controller. In the following description, a state where a magnetic force is generated is referred to as an ON state and a state where a magnetic force is not generated is referred to as an OFF state. FIGS. 6A and 6B show the OFF state, where the fitting projection 86 is urged to the front side by the urging spring 87 to be held at a position that the front and rear stopper 86*a* is abutted with the main body part 89. On the other hand, FIG. 6C shows the ON state, where the fitting projection 86 is held at a position abutting with the electromagnet 88 against an urging force of the urging spring 87. In the drive device 80 structured as described above, rotational driving of the right and left drive motor 83 is controlled by the controller so that the drive belt 84 (drive carriage 85) is controlled to move in the right and left direction.

As shown in FIG. 2, a first maintenance device 55 is provided on a lower side of the guide rail 40 in the right main body part 6 so as to face the first printing device 50 in the upper and lower direction, which has been moved at a first maintenance position on the right side of the platen 30. The first maintenance device 55 is structured so that suction caps 56 for covering under faces of the printer heads 52 (face where the ejection nozzle is formed) to prevent from being dried are attached on an upper face side of a stage 57 which is movable in the upper and lower direction. Further, the inside of the suction cap 56 is set in a negative pressure in a state that the under face of the printer head 52 is covered by the suction cap 56 so that the ink within the ejection nozzle is sucked and discharged. As described below, when the first printing device 50 is moved to the first maintenance position, the stage 57 is automatically moved upward and the under faces of the printer heads 52 are covered by the suction caps 56 to prevent the ejection nozzles from being dried. Further, in this case, the suction caps 56 are abutted with the under faces of the printer heads 52 and thus the first printing device 50 is held at the first maintenance position. A left end part of the stage 57 is attached with a wiper 58, which is made of flexible material such as rubber and capable of abutting with the under face of the printer head 52, so as to be movable in the front and rear direction.

A second maintenance device 65 is provided on a lower side of the guide rail 40 in the left main body part 5 so as to face the second printing device 60 in the upper and lower direction which has been moved to a second maintenance position on the left side of the platen 30. The second maintenance device 65 is, similarly to the first maintenance device 55 described above, attached with suction caps 66 and a wiper 68 on an upper face side of the stage 67 and structured so as to perform similar operations to the first maintenance device 55.

The above-mentioned description is for the structure of the printer apparatus 1 and next, an operation of the respective structure members at the time of printing will be described below with reference to FIG. 4 through FIG. 6C. In the following description, in order that a feature operation of the printer apparatus 1 according to the embodiment of the present invention is easily understood, an operation of the drive device 80 (drive carriage 85) will be mainly described below. In the following description, an example will be described in which, first, after printing has been performed over the entire printing region of a printing sheet 8 by using the basic colors, special colors are adhered to the printing region where the basic colors have been adhered to complete printing.

Before printing is started (standby state), for example, as shown in FIG. 4, the drive carriage 85 is not connected with the first printing device 50 and the second printing device 60. Further, the first printing device 50 is held at the first maintenance position by the first maintenance device 55 and the second printing device 60 is held at the second maintenance position by the second maintenance device 65 respectively. When printing is started by an operator who operates the printer apparatus 1, the right and left drive motor 83 is driven and controlled based on an operation signal from the controller and the drive carriage 85 is moved to the right side to the first maintenance position.

6A and 6B, the fitting projection 86 is abutted with the connecting part 53 to be moved backward and then, the fitting projection 86 is fitted into the fitting recessed part 53*a* at the first maintenance position. In this state, the first maintenance device 55 having been moved upward and holding the first printing device 50 is moved downward. In a state that the fitting projection 86 is fitted into the fitting recessed part 53*a* and the drive carriage 85 and the first printing device 50 are connected with each other as described above, when the right and left drive motor 83 is driven and controlled, the first printing device 50 can be controlled and moved along the guide rail 40 in the right and left direction.

After the wiper 58 is moved to the front and rear position which is capable of abutting with the under faces of the printer heads 52, the first printing device 50 is moved from the first maintenance position to the left side. As a result, unnecessary inks stuck to the under faces of the printer heads 52 are wiped off by the wiper 58 to maintain ejection performance of the ink (see FIG. 2). As shown in FIG. 5, on an upper side of a printing sheet 8 which is placed on the platen 30, an operation where inks are ejected from the printer heads 52 while the first printing device 50 is moved in the right and left direction reciprocatedly and an operation feeding the printing sheet 8 to the front side are performed in a combined manner and, as a result, printing with the use of the basic colors is performed over the entire printing region of the printing sheet 8.

When printing with the use of the basic colors has been finished, the drive carriage 85 (first printing device 50) is moved to the first maintenance position and the first maintenance device 55 is moved upward and the electromagnet 88 is set in an ON state (see FIG. 6C). In the ON state, the fitting of the fitting projection 86 into the fitting recessed part 53*a* is released and, after the first printing device 50 is held at the first maintenance position, the drive carriage 85 is moved to the second maintenance position. Similarly to the first printing device 50, the electromagnet 88 is set in an OFF state to connect the drive carriage 85 with the second printing device 60 (fitting projection 86 is fitted into the fitting recessed part 63*a*). In this state, while the second printing device 60 is moved in the right and left direction reciprocatedly, printing with the use of the special colors is performed over the entire printing region of the printing sheet 8 to complete printing to the printing sheet 8. In accordance with a printing type, there may be a case that printing with the use of the special colors is not required and printing is performed only by using the basic colors. In this case, only printing may be performed by connecting the first printing device 50 with the drive carriage 85 in the above-mentioned description.

In the conventional structure in which printing is performed by using the special colors together with the basic colors, a number of printer heads for the basic colors and a plurality of special colors whose actual use frequencies are indistinct are collectively mounted on one carriage that is extended longer in the right and left direction to structure a printing device and printing is performed while the printing device is moved in the right and left direction. On the other hand, in the printer apparatus 1 in accordance with the embodiment of the present invention, as described above, the first printing device 50 in which only the printer heads 52 for the basic colors commonly used at the time of normal printing are mounted on the carriage 51 so that inks are supplied from ink cartridges through the tubes 7, and the second printing device 60 in which the printer heads 62 for the special colors extremely rarely used according to a printing type are detachably mounted on the carriage 61 are provided separately. Therefore, while versatility is secured by using special colors for corresponding to various types of printing, since the first printing device 50 is structured so that only the printer heads 52 used for normal printing are mounted, a width in the right and left direction of the first printing device 50 is shortened and its size can be reduced. Since the weight of the first printing device 50 is reduced together with the downsizing, the first printing device 50 can be reciprocatedly moved in the right and left direction with a small driving force at the time of printing and thus the size of the right and left drive motor 83 can be reduced.

In addition, although required special colors may be different corresponding to a printing type, printing can be easily performed by means of that printer heads 62 on the carriage 61 are changed to another printer heads 62 for required special colors or printer heads 62 for required special colors are added each time. Further, since only a required printer head 62 is selected and purchased, the cost of the printer apparatus 1 can be reduced while printing with the special colors are enabled. As described above, a printer head 62 for a required special color is mounted on the carriage 61 only when it is required to perform printing and, on the other hand, a printer head 62 which is not used is detached from the carriage 61 to be stored and thus a condition where the printer heads 62 are exposed to air, dust and the like is reduced and the service life of the printer heads 62 can be made longer.

[Second Embodiment]

Figure 7:
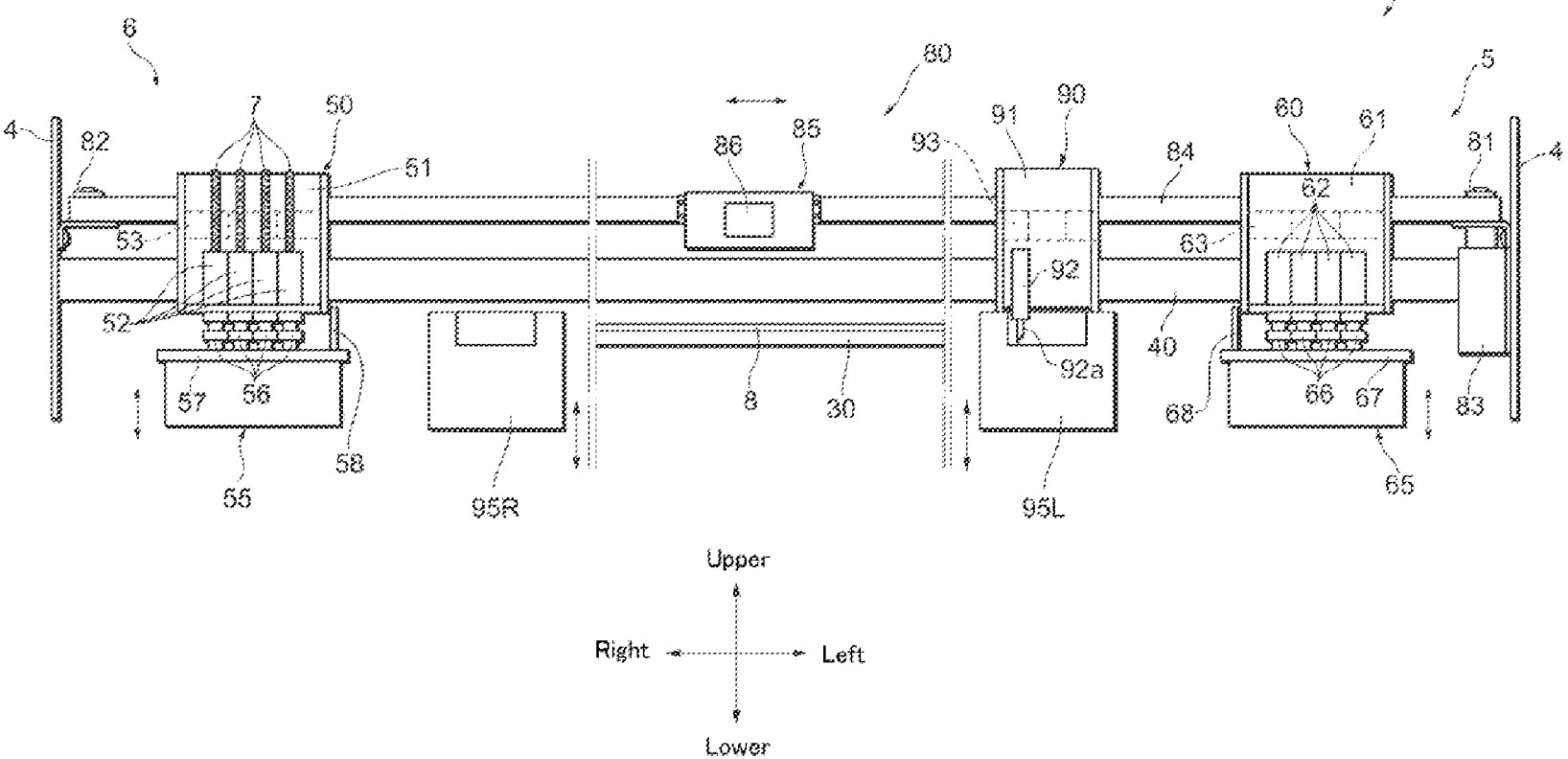
FIG. 7 is a front view showing a vicinity of a guide rail of a printer apparatus in accordance with the second embodiment.
Figure 8:
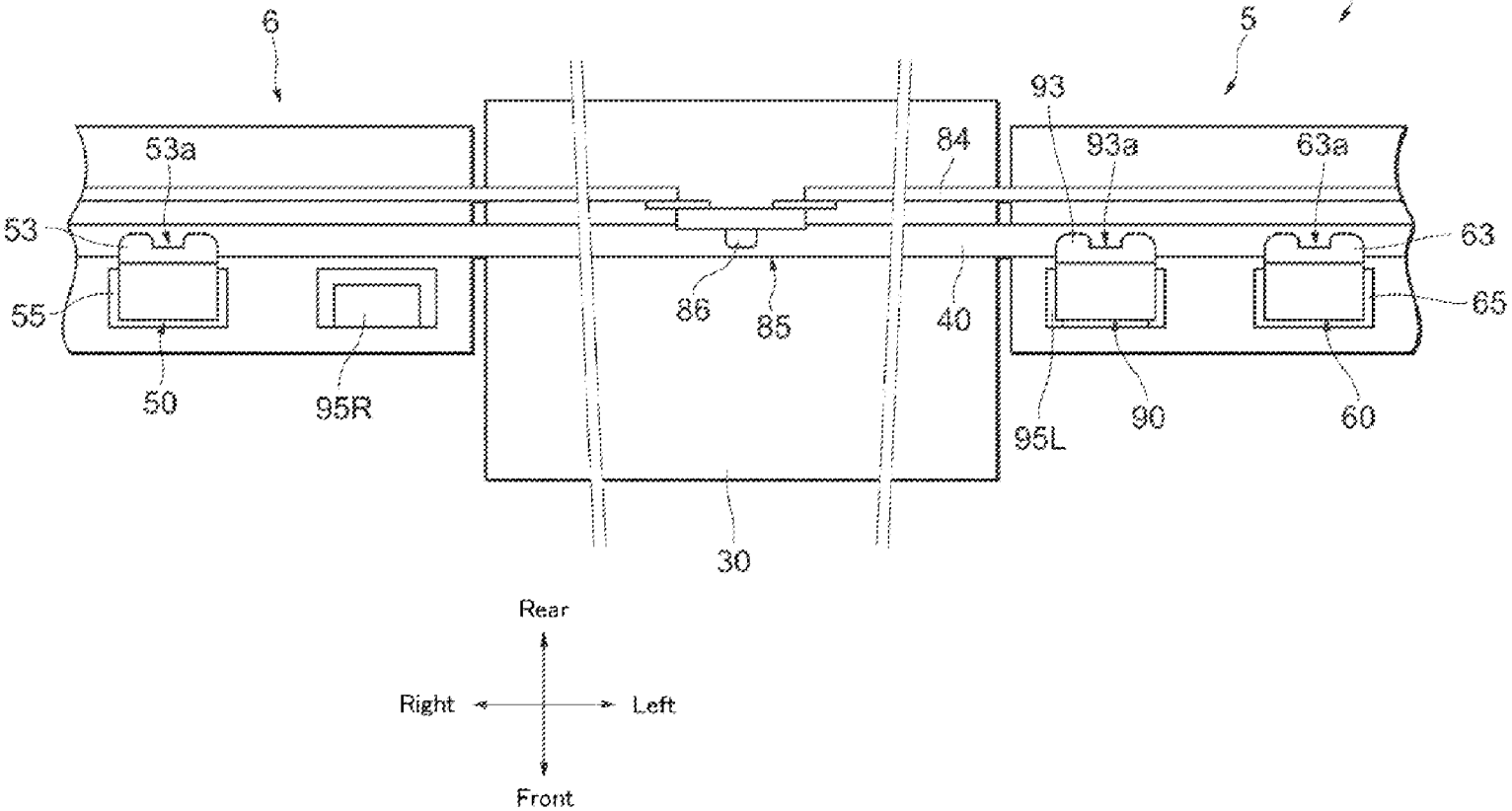
FIG. 8 is a plan view showing a vicinity of a guide rail of the printer apparatus.

A printer apparatus 10 in accordance with a second embodiment will be described below with reference to FIGS. 7 and 8. FIG. 7 shows an internal structure of a main body part 3 in a printer apparatus 10 and FIG. 8 is a plan view showing the main body part 3 respectively. The printer apparatus 10 is structured so that a cutting device 90, a right standby station 95R and a left standby station 95L described below are added to the printer apparatus 1 in accordance with the first embodiment and thus the same numbers are used for the same members of the printer apparatus 1 in accordance with the first embodiment and their descriptions are omitted. In FIGS. 7 and 8, the right standby station 95R and the left standby station 95L are provided on right and left sides with respect to the platen 30 but only one station (for example, only the right standby station 95R) may be provided.

The cutting device 90 is, as shown in FIG. 7, mainly structured of a carriage 91 which is movably attached to the guide rail 40 in the right and left direction and a cutter holder 92 which is mounted on the carriage 91. Similarly to the carriage 51, a plate-shaped connecting part 93 whose center portion is formed with a fitting recessed part 93*a* is provided on the rear side of the carriage 91 so as to extend to the rear side (see FIG. 8). A cutter blade 92*a* is detachably mounted on a lower end part of the cutter holder 92 and movably mounted on the carriage 91 in an upper and lower direction.

The left standby station 95L is formed in a roughly rectangular solid shape and provided on an lower side of the guide rail 40 in the left main body part 5. The left standby station 95L faces the cutting device 90 in the upper and lower direction which has been moved to a left standby position on a left side of the platen 30. When the left standby station 95L is moved upward in the state that the cutting device 90 has been moved to the left standby position, the left standby station 95L is abutted with an under face of the cutting device 90 and the cutting device 90 is held at the left standby position (see FIG. 7). As shown in FIG. 7, a width in the right and left direction of the left standby station 95L is shorter than the first maintenance device 55 and the left standby station 95L is structured simple in comparison with the first maintenance device 55. The right standby station 95R is structured similarly to the left standby station 95L and provided at a right standby position on the right side of the platen 30.

The above-mentioned description is for the structure of the printer apparatus 10. Next, a printing method and a cutting method which are used in the printer apparatus 10 will be described below as an example in which, after printing has been performed by using the basic colors, printing is performed by using special colors and, finally, the printed sheet is cut in a predetermined shape by using the cutter blade 92*a*. In this example, the cutting device 90 is, for example, held at the left standby station 95L as shown in FIG. 7 before printing is started.

When printing is started in the state shown in FIG. 7, similarly to the above-mentioned first embodiment, the drive carriage 85 and the first printing device 50 are connected with each other and printing is performed by using the basic colors. When the printing with the use of the basic colors has been finished, the first printing device 50 is moved to the first maintenance position and held by the first maintenance device 55. Next, the drive carriage 85 is to be connected with the second printing device 60 for performing printing with the use of the special colors. However, in this case, since the cutting device 90 is obstructively located on the right side of the second printing device 60, the second printing device 60 is unable to be moved on an upper side of the printing sheet 8 due to the cutting device 90. Therefore, the drive carriage 85 is moved to the left standby position in a state that the electromagnet 88 is set in an OFF state and then the fitting projection 86 is fitted into the fitting recessed part 93*a* and the drive carriage 85 is connected with the cutting device 90 and the left standby station 95L is moved downward.

Next, the cutting device 90 is moved to the right standby position and the right standby station 95R is moved upward to hold the cutting device 90. As a result, like the above-mentioned first embodiment, it is capable of that the drive carriage 85 is connected with the second printing device 60 and that the second printing device 60 is moved on the upper side of the printing sheet 8 to perform printing with the use of the special colors. When the printing with the use of the special colors has been finished, the second printing device 60 is moved to the second maintenance position and held by the second maintenance device 65.

Next, the drive carriage 85 is moved to the right standby position and connected with the cutting device 90 which has been moved to the right standby position as mentioned above and then the printing sheet 8 is cut in a predetermined shape by the cutting device 90. When the cutting step has been finished, the cutting device 90 is, as shown in FIG. 7, moved to the left standby position and held by the left standby station 95L and the printing and the cutting by the printer apparatus 10 are completed.

As described above, the printer apparatus 10 is structured so that, among the first printing device 50, the second printing device 60 and the cutting device 90 which are attached to the guide rail 40, a device which obstructs movement to the upper side of the platen 30 (cutting device 90 in the above-mentioned example) is moved to the opposite side with respect to the platen 30 (right side of the platen 30 in the above-mentioned example) and the right standby station 95R and the left standby station 95L are provided for holding the device at the moved position. Therefore, each of three devices provided on the guide rail 40 is capable of being moved to the upper side of the platen 30 as needed and thus, in addition to printing with the use of the basic colors and the special colors, the printed sheet can be cut in a predetermined shape and the versatility of the printer apparatus 10 can be further improved. Further, the cutting device 90 is arranged between the first printing device 50 and the second printing device 60 on the guide rail 40 and the right standby station 95R and the left standby station 95L whose structures are smaller and simpler in comparison with the first maintenance device 55 are provided on both of the right and left sides of the platen 30. Therefore, the printer apparatus 10 can be structured in a relatively compact manner in the right and left direction and its cost can be reduced.

[Third Embodiment]

Figure 9:
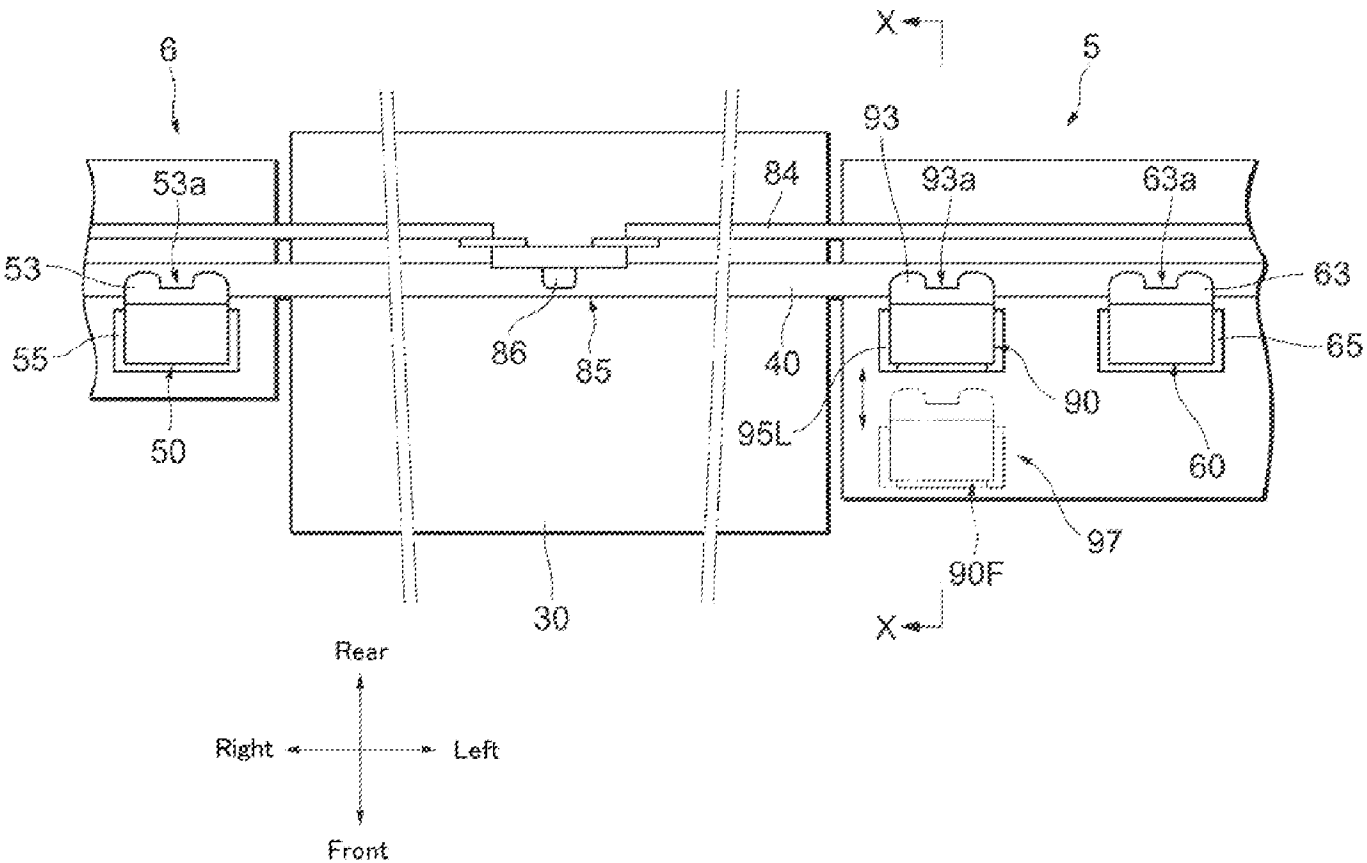
FIG. 9 is a plan view showing a vicinity of a guide rail of a printer apparatus in accordance with the third embodiment.
Figure 10:
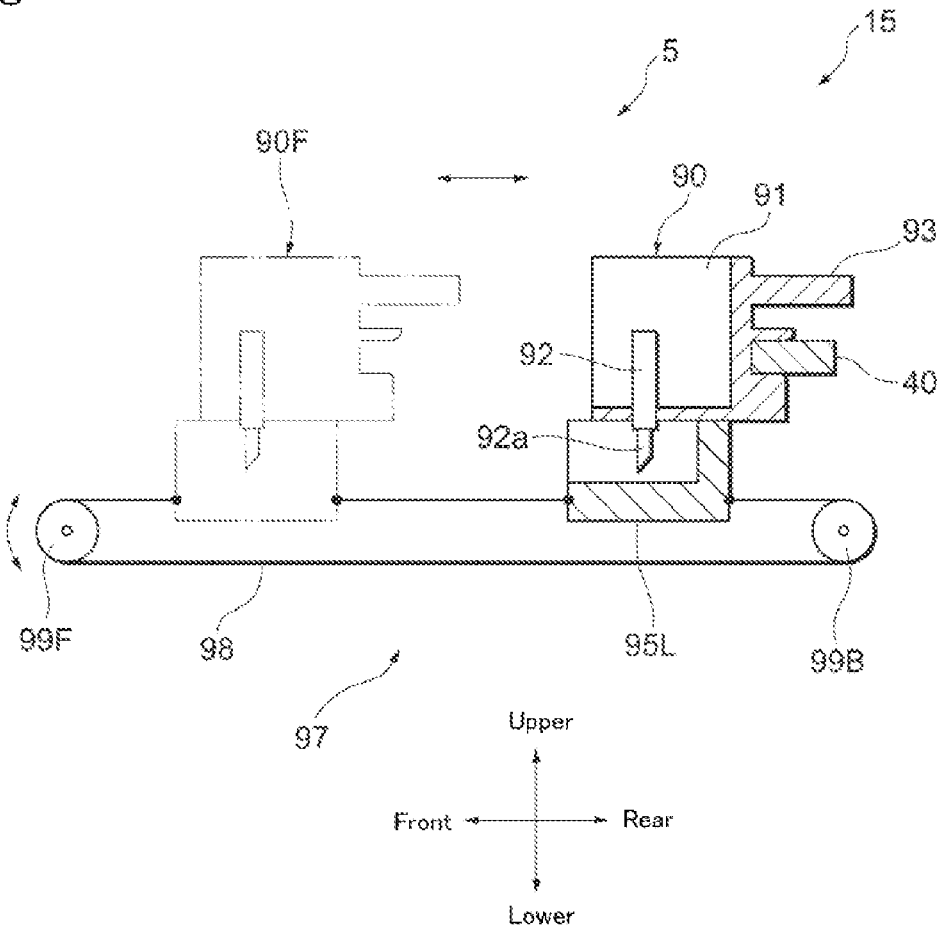
FIG. 10 is a side view (partly cross-sectional view) showing a device retreat mechanism of the printer apparatus.

Next, a printer apparatus 15 in accordance with a third embodiment will be described below with reference to FIGS. 9 and 10. FIG. 9 is a plan view showing a main body part 3 in a printer apparatus 15 and FIG. 10 is a cross-sectional view showing the "X-X" portion in FIG. 9 respectively. The printer apparatus 15 is, in comparison with the printer apparatus 10 in accordance the second embodiment, structured so that the right standby station 95R is removed and a device retreat mechanism 97 described below is added in the left main body part 5. Therefore, the same numbers are used in the same members as those of the printer apparatuses 1 and 10 in accordance with the first and the second embodiments and their descriptions are omitted.

The device retreat mechanism 97 is, as shown in FIG. 10, mainly structured of a drive pulley 99F, which is provided in the left main body part 5 and is driven and rotated by a front and rear drive motor (not shown), a driven pulley 99B which is located on a rear side of the drive pulley 99 F, and a belt-shaped drive belt 98 which is stretched over the pulleys 99F and 99B. A left standby station 95L is connected with the drive belt 98 and, when the front and rear drive motor is driven to drive and rotate the drive pulley 99F, a cutting device 90 which is held by the left standby station 95L is moved and slid to the front side together with the left standby station 95L. The cutting device 90 is moved and slid as described above and moved to a front position (position of the cutting device 90F). In accordance with an embodiment, for example, a stepping motor, a servomotor or the like may be used as the front and rear drive motor.

The above-mentioned description is for the structure of the printer apparatus 15. Next, a printing method and a cutting method which are used in the printer apparatus 15 will be described below as an example in which, after printing has been performed by using the basic colors, printing is performed by using special colors and, finally, the printed sheet is cut in a predetermined shape by using a cutter blade 92*a*. In this example, as shown in FIG. 9, the cutting device 90 has been moved by the device retreat mechanism 97 to a rear side position with respect to a position capable of moving in the right and left direction along the guide rail 40 before printing is started.

When printing is started in the state shown in FIG. 9, similarly to the above-mentioned first embodiment, the drive carriage 85 and the first printing device 50 are connected with each other and printing is performed by using the basic colors. When the printing with the use of the basic colors has been finished, the first printing device 50 is moved to the first maintenance position and held by the first maintenance device 55. Next, the drive carriage 85 is to be connected with the second printing device 60 for performing printing with the use of the special colors. However, in this case, since the cutting device 90 is obstructively located on the right side of the second printing device 60, the second printing device 60 is unable to move on an upper side of the printing sheet 8 due to the cutting device 90. Therefore, the front and rear drive motor in the device retreat mechanism 97 is driven so that the cutting device 90 at the rear position is moved and slid to a front position (cutting device 90F shown in FIG. 10) together with the left standby station 95L. As a result, like the first embodiment described above, the drive carriage 85 can be connected with the second printing device 60 and the second printing device 60 is moved on the upper side of the printing sheet 8 to perform printing with the use of the special colors. When the printing with the use of the special colors has been finished, the second printing device 60 is moved to the second maintenance position and held by the second maintenance device 65.

Next, the front and rear drive motor is driven to move and slide the cutting device 90 F located at the front position to the rear position together with the left standby station 95L. Next, in a state that the electromagnet 88 is set to be in an OFF state, the drive carriage 85 is moved to the left standby position and connected with the cutting device 90 (the fitting projection 86 is fitted into the fitting recessed part 93*a*) which has been moved and slid to the rear position and then the printing sheet 8 is cut in a predetermined shape by the cutting device 90. When the cutting step has been finished, the cutting device 90 is, as shown in FIG. 9, moved to the left standby position and held by the left standby station 95L and the printing and the cutting by the printer apparatus 15 are completed.

As described above, in the printer apparatus 15, the cutting device 90 is moved and slid in the front and rear direction by the device retreat mechanism 97 as needed. Therefore, in addition to printing by using the basic colors and the special colors, the printed sheet can be cut in a predetermined shape and thus versatility of the printer apparatus 15 can be improved. In this case, since the printer apparatus 15 is provided with only one left standby station 95L, in comparison with the printer apparatus 10 in the second embodiment, the printer apparatus 15 can be structured further compact in the right and left direction.

Figure 11:
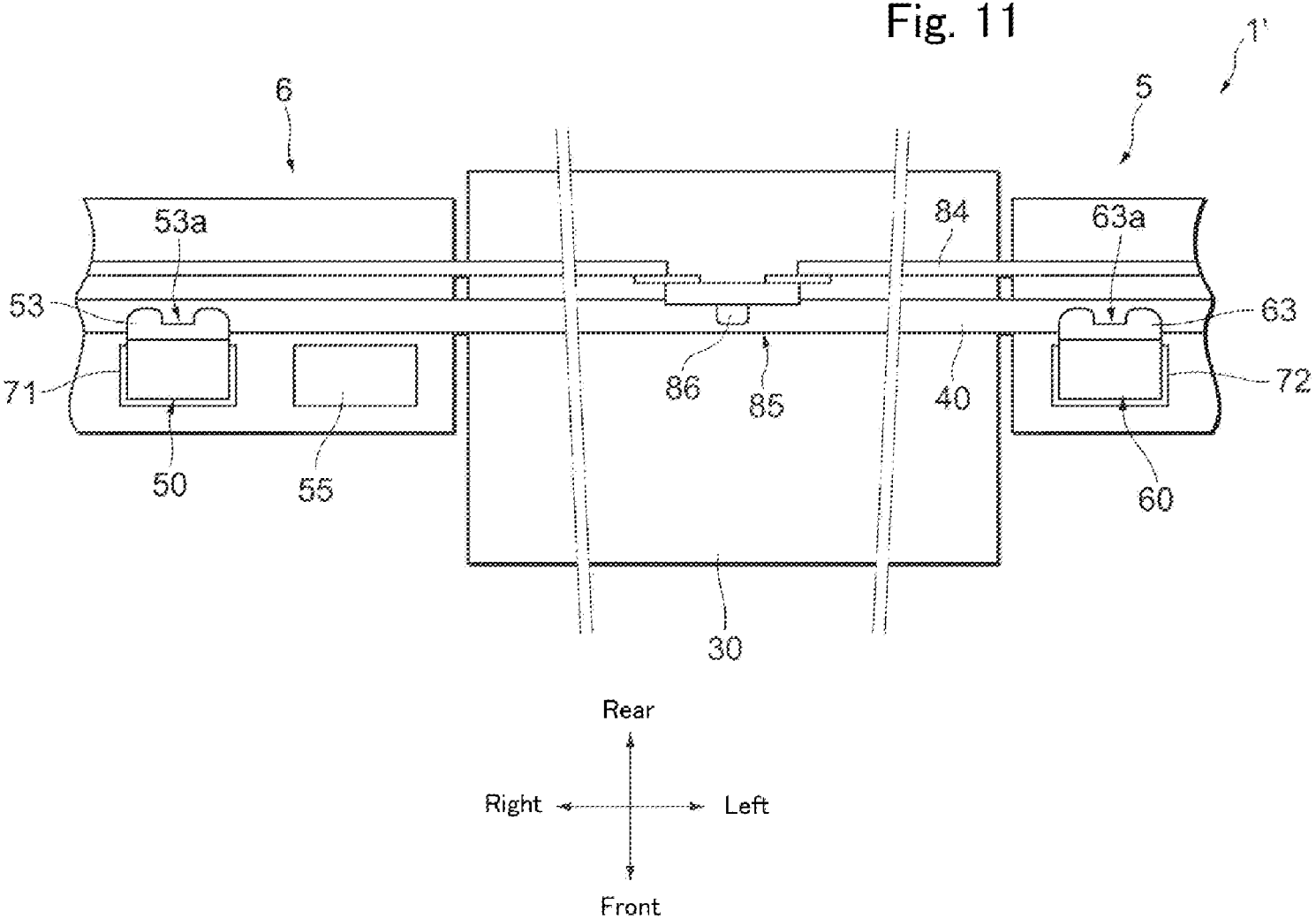
FIG. 11 is a plan view showing a modified example of the printer apparatus in accordance with the first embodiment.
Figure 12:
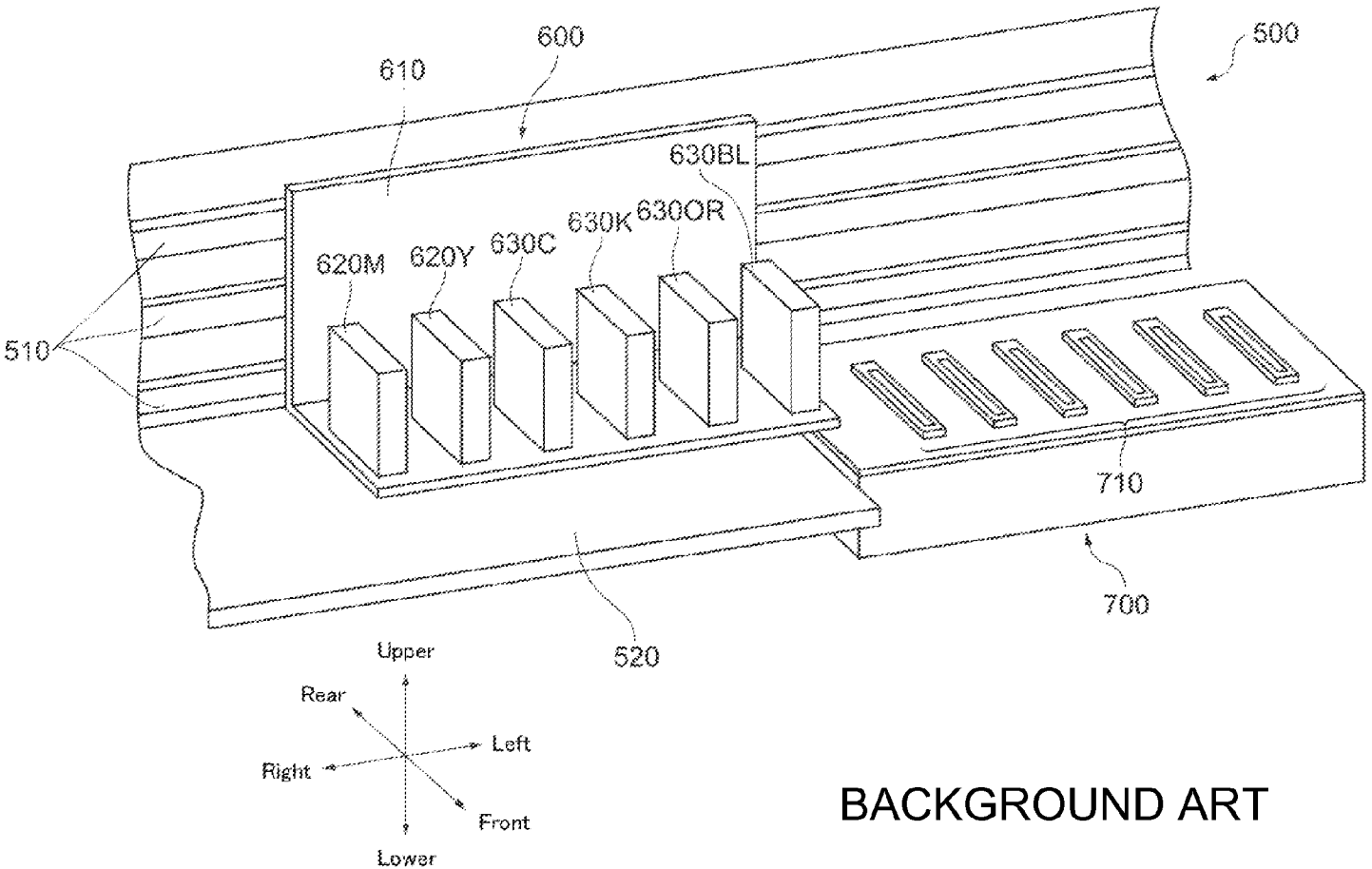
FIG. 12 is a perspective view showing a vicinity of a printing device of a conventional printer apparatus.

As a modified example of the first embodiment, for example, a printer apparatus 1' shown in FIG. 11 may be structured. The first printing device 50 and the second printing device 60 shown in FIG. 11 are structured so that the number of printer heads mounted on the respective carriages 51 and 61 is the same (for example, four) as each other. In the right main body part 6, a capping device 71 for covering under faces of the printer heads 52 mounted on the first printing device 50 to prevent drying is provided on the right side of the first maintenance device 55. In the left main body part 5, a capping device 72 is provided for covering under faces of the printer heads 62 mounted on the second printing device 60 to prevent drying.

In the structure as described above, the under face of the printing device which is not used for printing is covered by the capping device corresponding to the printing device to prevent drying and, when printing is to be started, the printing device is moved from the right side to the left side on the upper side of the first maintenance device 55 to perform maintenance. In this example, since the first maintenance device 55 is commonly used for both of the first printing device 50 and the second printing device 60, the second maintenance device 65 in the first embodiment is omitted. Therefore, the cost is further reduced and a width in the right and left direction of the printer apparatus 1' is further reduced in a compact manner. Further, when the wiper 58 is abutted with the under face of a printer head to wipe off unnecessary ink, different color's ink may be pushed into the ejection nozzle by the wiper 58 due to its structure. In order to prevent this situation, it is preferable that the wiper 58 is abutted with the under face of the printer head while its ink is ejected from the ejection nozzle.

As another printing method in the first embodiment, for example, a printer head 62 which stores a pre-treating agent (undercoat agent) and a printer head 62 which stores a post-treating agent (overcoat agent) are mounted on the second printing device 60 and, first, the drive carriage 85 is connected with the second printing device 60 and a pre-treating agent is ejected to a printing sheet 8. Next, the drive carriage 85 is connected with the first printing device 50 and, after printing by using the basic colors has been performed, the drive carriage 85 is connected with the second printing device 60 again to eject a post-treating agent. According to this structure, in comparison with a case that all the printer heads (basic colors, a pre-treating agent and a post-treating agent) are mounted on one piece of carriage, while the first and the second printing devices 50 and 60 are structured compact in the right and left direction, printing with the use of a pre-treating agent and a post-treating agent can be performed. In accordance with an embodiment, when the second printing device 60 is, for example, structured to be capable of mounting four pieces of printer heads, one piece of the printer head 62 for a pre-treating agent and one piece of the printer head 62 for a post-treating agent may be mounted and, alternatively, two pieces for a pre-treating agent and two pieces for a post-treating agent may be respectively mounted. In other words, in a condition of totaled four pieces, the number of the printer head 62 for a pre-treating agent and the printer head 62 for a post-treating agent may be arbitrarily set depending on their use frequencies.

As a modified example of the first embodiment, for example, it may be structured that all of the printer heads 52 in the first printing device 50 and the printer heads 62 in the second printing device 60 are structured so that inks are capable of being stored in the insides of the respective heads and all of the printer heads 52 and the printer heads 62 are detachably mounted on the respective carriages 51 and 61. According to this structure, printer heads may be mounted in a free combined manner on the respective carriages 51 and 61 and thus, for example, only printer heads for required colors may be mounted on the carriage to perform printing depending on which colors are required. Further, it is preferable that, printer heads whose inks are unable to be simultaneously ejected and adhered on a surface of a printing sheet 8 are not mounted on the same carriage.

In the second and the third embodiments, as a using example of the printer apparatuses 10 and 15, after printing has been performed by using the basic colors and the special colors, a cutting work is performed on the printed sheet, but the present invention is not limited to this method. For example, after printing with the use of the basic colors has been performed, a cutting work may be performed on the printed sheet and, alternatively, only cutting may be performed without performing printing on a printing sheet 8.

In the first through the third embodiments, the first printing device 50 and the second printing device 60 may be simultaneously connected with the drive carriage 85. According to this structure, working time required for connection and separation can be shortened. Further, in the second and the third embodiments, when the first printing device 50 and the cutting device 90 or the second printing device 60 and the cutting device 90 are simultaneously connected with the drive carriage 85, a print-and-cut operation can be performed. In addition, it may be structured so that the drive carriage 85 and the first printing device 50 are always connected with each other as one structured member and the second printing device 60 or the cutting device 90 is connected with the above-mentioned one structured member as needed. In this case, similarly to the case as described above, working time required for connection and separation can be shortened.

In the third embodiment described above, the device retreat mechanism 97 is used in which the front and rear drive motor is driven to slidably move the cutting device 90 to the front position and the rear position. However, the present invention is not limited to this structure. For example, an air cylinder may be used for moving the cutting device 90 to the front position and the rear position.

In the embodiment described above, for example, it may be structured that the first printing device 50 and the first maintenance device 55 are set in a basic structure and the second printing device 60, the second maintenance device 65, the cutting device 90, the right standby station 95R and the left standby station 95L are set in extended structures which are provided as needed. According to this structure, an optimized printer apparatus in which unnecessary functions are omitted and only necessary functions are provided and a printer apparatus with a high degree of cost performance can be realized.

In the embodiment described above, the present invention is applied to a printer apparatus in one axis printing sheet moving type and one axis printing device moving type but the present invention is not limited to this structure. The present invention may be applied to another type of a printer apparatus, for example, to a printer apparatus in two axes printing device moving type or in two axes printing sheet moving type. Further, the inks which are used are not limited to a dye-based ink or a pigment-based ink and the present invention may be applied to a printer apparatus in which, for example, an ultraviolet curing type ink is used.

According to the embodiment of the invention, it is preferable that an ink tank in which ink is stored is mounted on the printer apparatus and the first head is structured so that the first head is connected with the ink tank through a supply tube (for example, the tube 7 in the embodiment) and that the ink is supplied to the first head from the ink tank, and the second head is structured so that a predetermined quantity of ink can be stored in an inside of the second head and the second head is detachably mounted on the second carriage.

Further, it is preferable that the first head is structured of a plurality of basic color ink heads (for example, the printer heads 52 in the embodiment) for ejecting respective colors of at least yellow, magenta, cyan and black, and the second head is structured of a special ink head (for example, the printer head 62 in the embodiment) for ejecting ink whose use frequency is lower than those of the basic color ink heads.

In addition, it is preferable that the printer apparatus includes a third device (for example, the cutting device 90 in the embodiment) which is provided with a third carriage (for example, the carriage 91 in the embodiment) that is movable in the scanning direction along the guide rail and a cutter device (for example, the cutter holder 92 in the embodiment) which is mounted on the third carriage to cut the object medium in a predetermined shape, a third connecting mechanism (for example, the fitting projection 86 and the connecting part 93 in the embodiment) which connects the third device with the driving member in a separable manner, and a third holding mechanism which is provided on at least one of the one side and the second side and is capable of holding the third device.

Further, in this case, it is preferable that, when the object medium is to be cut in a predetermined shape by using the cutter device, the first device and the second device are separated from the driving member and held by the first holding mechanism and the second holding mechanism, and the third device is connected with the driving member by the third connecting mechanism.

Further, it is preferable that the first device, the second device and the third device are provided along the guide rail extending along a straight-line, and the third device is provided between the first device and the second device.

It is preferable that the third holding mechanism is structured of a one side standby station (for example, the right standby station 95R in the embodiment) which is provided on the one of the sides and the other side standby station (for example, the left standby station 95L in the embodiment) which is provided on the other of the sides.

Further, it is also preferable that the medium supporter is formed with a medium support face facing the first head and the second head in an upper and lower direction, and a device retreat mechanism (for example, the device retreat mechanism 97 in the embodiment) is provided which is capable of moving the third device in parallel to the medium support face and in a direction separated from the guide rail.

The printer apparatus in accordance with the embodiment of the present invention which is structured as described above is structured so that the first head and the second head for ejecting inks are separately mounted on the first device and second device respectively, and the driving member is connected with one of these devices and ink is ejected from the printer head while moving in the scanning direction to perform printing. In this structure, for example, when a printer head for ejecting ink of a basic color is used as the first head and a printer head for ejecting a special color is used as the second head, the respective devices are structured to be compact and their weights are reduced in comparison with a case that all of the printer heads for basic colors and special colors are mounted on one carriage in a juxtaposed manner in advance for coping with printing with the use of the special colors. Further, in the normal printing, printing is often performed by using only the basic colors and the first device which is mainly moved in the scanning direction at the time of normal printing is compact and its weight is lighter and thus forces acting on the respective drive portions can be reduced. In addition, when the printer heads for the basic colors and the printer heads for special colors are mounted on different devices as described above, for example, for a customer who requires printing by using only the basic colors, a printer apparatus can be provided with a high degree of cost performance by omitting the second device to restrict necessary functions. In this case, printing with the use of the special colors can be performed by simply adding the second device as needed.

In the printer apparatus according to the embodiment of the invention, it is preferable that the first head is structured so that ink is supplied from an ink tank and the second head is structured so that ink is stored in its inside and is detachably mounted on the second carriage. In this structure, for example, when the first heads are used as printer heads for basic colors and the second heads are used as printer heads for special colors, inks of the basic colors which are mainly used at the time of normal printing are stored in large quantities in ink tanks and inks of the special colors which are extremely rarely used are stored in small quantities in the insides of the second heads for securing stored inks corresponding to eject quantity (using quantity). Further, in this case, a supply tube and an ink tank are not required for the second head and thus an ink supply path is simply and easily structured and cost can be reduced. In addition, when the ink supply path is structured as described above, the second heads required depending on printing type are easily attached and changed.

Further, it is preferable that the first head is structured of basic color ink heads for yellow, magenta, cyan and black, and the second head is structured of a special ink head for ejecting ink whose use frequency is lower than those of the basic color heads. According to this structure, the printer heads are separated depending on use frequency (eject quantity of ink) at the time of normal printing and mounted on different devices and thus an optimum supply system can be adopted for each device among a tube supply system, a supply system in which ink is stored in its printer head and the like.

The printer apparatus according to the embodiment of the invention is provided with the third device on which the cutter device is mounted and is structured so that the driving member is connected with the third device and, while moving in the scanning direction, an object medium can be cut in a predetermined shape. According to this structure, a printer apparatus with a high degree of versatility is structured which is capable of coping with all of a case that only printing is performed on an object medium, a case that only a cutting work is performed, and a case that both of printing and a cutting work are performed. Further, in a case that a cutting work is to be performed in addition to printing, for example, in comparison with a case that printing and a cutting work are performed in separate devices, a cutting work is performed on a printed medium having been printed in a predetermined shape on a mounted state without detaching from the printer apparatus. Therefore, a working time required for printing and a cutting work can be remarkably reduced.

In the printer apparatus according to the embodiment of the invention, it is preferable that the first through the third devices are provided along the guide rail in a straight-line manner, and the third device is provided between the first device and the second device. In this structure, when the first through the third devices are separately arranged on both sides of the medium supporter, one of the first device and the second device is obstructed by the third device to be unable to move on an upper side of the medium supporter and thus the third device is required to be retreated by a certain method. In this case, in comparison with a case that the first device or the second device on which a printer head is mounted is retreated, the third device whose structure is simple is easily retreated.

Further, it is preferable that the third holding mechanism is structured of a one side standby station and the other side standby station which are provided on sides of the medium supporter. According to this structure, since the third device can be held on both sides in the scanning direction of the medium supporter, for example, when the third device is provided between the first device and the second device, the third device is held in either standby station to avoid obstructing the first device or the second device which is to be located for being used on the upper side of the medium supporter.

Further, it is also preferable that a device retreat mechanism is provided which is capable of moving the third device in parallel to the medium support face formed in the medium supporter and in a direction separated from the guide rail. Also in this case, for example, when the third device is provided between the first device and the second device, the third device is retreated by the device retreat mechanism to avoid obstructing the first device or the second device which is to be located for being used on the upper side of the medium supporter and printing and a cutting work are performed by using the first, the second or the third device as needed.

Obviously, numerous modifications and variations of the present invention are possible in light of the above teachings. It is therefore to be understood that within the scope of the appended claims, the invention may be practiced otherwise than as specifically described herein.

The invention claimed is:

1. A printer apparatus comprising:

a guide rail which faces a medium supporter to support an object medium and which is relatively movable in a predetermined feeding direction with respect to the object medium supported by the medium supporter, the guide rail extending in a scanning direction perpendicular to the predetermined feeding direction;

a first device comprising:

a first carriage movable in the scanning direction along the guide rail; and a first head mounted on the first carriage so that ink is ejected to the object medium from the first head;

a second device comprising:

a second carriage movable in the scanning direction along the guide rail; and a second head mounted on the second carriage so that ink is ejected to the object medium from the second head;

a hauling device comprising a driving member movable in the scanning direction between the first device and the second device;

a first connecting mechanism connecting the first device to the driving member when ink is to be ejected from the first head;

a second connecting mechanism connecting the second device to the driving member when ink is to be ejected from the second head;

a first holding mechanism provided on one side of said printer apparatus with respect to the medium supporter in the scanning direction and holding the first device separated from the driving member when ink is ejected from the second head;

a second holding mechanism provided on another side of said printer apparatus with respect to the medium supporter in the scanning direction and holding the second device separated from the driving member when ink is ejected from the first head;

a third device comprising:

a third carriage movable in the scanning direction along the guide rail; and a cutter device mounted on the third carriage to cut the object medium in a predetermined shape;

a third connecting mechanism detachably connecting the third device to the driving member; and a third holding mechanism which is provided on at least one of the one side and the another side of said printer apparatus with respect to the medium supporter in the scanning direction and which is capable of holding the third device;

wherein when the object medium is to be cut in a predetermined shape by using the cutter device, the first device and the second device are separated from the driving member and held by the first holding mechanism and the second holding mechanism respectively, and the third device is connected with the driving member by the third connecting mechanism.

2. The printer apparatus according to claim 1, wherein the first device, the second device and the third device are provided along the guide rail extending along a straight line and wherein the third device is provided between the first device and the second device.

3. The printer apparatus according to claim 1, wherein the third holding mechanism comprises a one side standby station provided on one side of said printer apparatus with respect to the medium supporter in the scanning direction, and an another side standby station provided on another side of said printer apparatus with respect to the medium supporter in the scanning direction.

4. The printer apparatus according to claim 1, wherein the medium supporter includes a medium support face facing the first head and the second head in an upper and lower direction, and wherein a device retreat mechanism is provided which is capable of moving the third device in parallel to the medium support face and in a direction separated from the guide rail.

5. The printer apparatus according to claim 1, wherein the first head comprises a plurality of basic color ink heads for ejecting respective colors of at least yellow, magenta, cyan and black, and wherein the second head comprises a special ink head for ejecting ink whose use frequency is lower than those of the basic color ink heads.

6. The printer apparatus according to claim 5, further comprising:

a third device comprising:

a third carriage movable in the scanning direction along the guide rail; and a cutter device mounted on the third carriage to cut the object medium in a predetermined shape;

a third connecting mechanism detachably connecting the third device to the driving member; and a third holding mechanism which is provided on at least one of the one side and the another side of said printer apparatus with respect to the medium supporter in the scanning direction and which is capable of holding the third device;

wherein when the object medium is to be cut in a predetermined shape by using the cutter device, the first device and the second device are separated from the driving member and held by the first holding mechanism and the second holding mechanism respectively, and the third device is connected with the driving member by the third connecting mechanism.

7. The printer apparatus according to claim 6, wherein the first device, the second device and the third device are provided along the guide rail extending along a straight-line and wherein the third device is provided between the first device and the second device.

8. The printer apparatus according to claim 6, wherein the third holding mechanism comprises a one side standby station provided on one side of said printer apparatus with respect to the medium supporter in the scanning direction, and an another side standby station provided on another side of said printer apparatus with respect to the medium supporter in the scanning direction.

9. The printer apparatus according to claim 6, wherein the medium supporter includes a medium support face facing the first head and the second head in an upper and lower direction, and wherein a device retreat mechanism is provided which is capable of moving the third device in parallel to the medium support face and in a direction separated from the guide rail.

10. A printer apparatus comprising:

a guide rail which faces a medium supporter to support an object medium and which is relatively movable in a predetermined feeding direction with respect to the object medium supported by the medium supporter, the guide rail extending in a scanning direction perpendicular to the predetermined feeding direction;

a first device comprising:

a first carriage movable in the scanning direction along the guide rail; and a first head mounted on the first carriage so that ink is ejected to the object medium from the first head;

a second device comprising:

a second carriage movable in the scanning direction along the guide rail; and a second head mounted on the second carriage so that ink is ejected to the object medium from the second head;

a hauling device comprising a driving member movable in the scanning direction between the first device and the second device;

a first connecting mechanism connecting the first device to the driving member when ink is to be ejected from the first head;

a second connecting mechanism connecting the second device to the driving member when ink is to be ejected from the second head;

a first holding mechanism provided on one side of said printer apparatus with respect to the medium supporter in the scanning direction and holding the first device separated from the driving member when ink is ejected from the second head;

a second holding mechanism provided on another side of said printer apparatus with respect to the medium supporter in the scanning direction and holding the second device separated from the driving member when ink is ejected from the first head;

an ink tank in which ink is stored;

a third device comprising:

a third carriage movable in the scanning direction along the guide rail; and a cutter device mounted on the third carriage to cut the object medium in a predetermined shape;

a third connecting mechanism detachably connecting the third device to the driving member; and a third holding mechanism which is provided on at least one of the one side and the another side of said printer apparatus with respect to the medium supporter in the scanning direction and which is capable of holding the third device, wherein the first head comprises a plurality of basic color ink heads for ejecting respective colors of at least yellow, magenta, cyan and black, wherein the second head comprises a special ink head for ejecting ink whose use frequency is lower than those of the basic color ink heads, wherein the first head is connected with the ink tank through a supply tube and is structured so that ink is supplied to the first head from the ink tank, and wherein the second head is detachably mounted on the second carriage and is structured so that a predetermined quantity of ink can be stored in an inside of the second head, and wherein when the object medium is to be cut in a predetermined shape by using the cutter device, the first device and the second device are separated from the driving member and held by the first holding mechanism and the second holding mechanism respectively, and the third device is connected with the driving member by the third connecting mechanism.

11. The printer apparatus according to claim 10, wherein the first device, the second device and the third device are provided along the guide rail extending along a straight-line and wherein the third device is provided between the first device and the second device.

12. The printer apparatus according to claim 10, wherein the third holding mechanism comprises a one side standby station provided on one side of said printer apparatus with respect to the medium supporter in the scanning direction, and an another side standby station provided on another side of said printer apparatus with respect to the medium supporter in the scanning direction.

13. The printer apparatus according to claim 10, wherein the medium supporter includes a medium support face facing the first head and the second head in an upper and lower direction, and wherein a device retreat mechanism is provided which is capable of moving the third device in parallel to the medium support face and in a direction separated from the guide rail.

14. A printer apparatus comprising:

a guide rail which faces a medium supporter to support an object medium and which is relatively movable in a predetermined feeding direction with respect to the object medium supported by the medium supporter, the guide rail extending in a scanning direction perpendicular to the predetermined feeding direction;

a first device comprising:

a first carriage movable in the scanning direction along the guide rail; and a first head mounted on the first carriage so that ink is ejected to the object medium from the first head;

a second device comprising:

a second carriage movable in the scanning direction along the guide rail; and a second head mounted on the second carriage so that ink is ejected to the object medium from the second head;

a hauling device comprising a driving member movable in the scanning direction between the first device and the second device;

a first connecting mechanism connecting the first device to the driving member when ink is to be ejected from the first head;

a second connecting mechanism connecting the second device to the driving member when ink is to be ejected from the second head;

a first holding mechanism provided on one side of said printer apparatus with respect to the medium supporter in the scanning direction and holding the first device separated from the driving member when ink is ejected from the second head;

a second holding mechanism provided on another side of said printer apparatus with respect to the medium supporter in the scanning direction and holding the second device separated from the driving member when ink is ejected from the first head;

a third device comprising:

a third carriage movable in the scanning direction along the guide rail; and a cutter device mounted on the third carriage to cut the object medium in a predetermined shape;

a third connecting mechanism detachably connecting the third device to the driving member; and a third holding mechanism which is provided on at least one of the one side and the another side of said printer apparatus with respect to the medium supporter in the scanning direction and which is capable of holding the third device, wherein the first head comprises a plurality of basic color ink heads for ejecting respective colors of at least yellow, magenta, cyan and black, wherein the second head comprises a special ink head for ejecting ink whose use frequency is lower than those of the basic color ink heads, and wherein when the object medium is to be cut in a predetermined shape by using the cutter device, the first device and the second device are separated from the driving member and held by the first holding mechanism and the second holding mechanism respectively, and the third device is connected with the driving member by the third connecting mechanism.

15. The printer apparatus according to claim 14, wherein the first device, the second device and the third device are provided along the guide rail extending along a straight-line and wherein the third device is provided between the first device and the second device.

16. The printer apparatus according to claim 14, wherein the third holding mechanism comprises a one side standby station provided on one side of said printer apparatus with respect to the medium supporter in the scanning direction, and an another side standby station provided on another side of said printer apparatus with respect to the medium supporter in the scanning direction.

17. The printer apparatus according to claim 14, wherein the medium supporter includes a medium support face facing the first head and the second head in an upper and lower direction, and wherein a device retreat mechanism is provided which is capable of moving the third device in parallel to the medium support face and in a direction separated from the guide rail.

* * * * *